US005295189A

United States Patent [19]

Fosgate

[11] Patent Number: 5,295,189

[45] Date of Patent: Mar. 15, 1994

[54] CONTROL VOLTAGE GENERATOR FOR SURROUND SOUND PROCESSOR

[76] Inventor: James W. Fosgate, 4750 E. 1200 South, Heber City, Utah 84032

[21] Appl. No.: 984,863

[22] Filed: Dec. 1, 1992

Related U.S. Application Data

[63] Continuation-in-part of Ser. No. 533,091, Jun. 8, 1990, Pat. No. 5,192,415.

[51] Int. Cl.[5] ..... H04S 3/00

[52] U.S. Cl. ..... 381/22

[58] Field of Search ..... 381/1, 18, 22

[56] References Cited

U.S. PATENT DOCUMENTS 3,632,886 1/1972 Scheiber .
3,708,631 1/1973 Bauer et al. .
3,746,792 7/1972 Scheiber .
3,836,715 9/1974 Ito et al. .
3,864,516 2/1975 Kameoka et al. .
3,883,692 5/1975 Tsurushima .
3,883,832 5/1975 Fosgate .
3,885,099 5/1975 Tsurushima .
3,943,287 3/1976 Gravereaux et al. .
3,944,735 3/1976 Willcocks .
3,959,590 5/1976 Scheiber .
4,704,728 11/1987 Scheiber .
4,891,839 2/1990 Scheiber .
4,932,059 6/1990 Fosgate .
5,046,098 9/1991 Mandell et al. .
5,172,415 12/1992 Fosgate ..... 381/22

*Primary Examiner*—Forester W. Isen
*Attorney, Agent, or Firm*—David L. McCombs

[57] ABSTRACT

A surround sound processor for presentation of a stereophonic source program on a multiple loudspeaker array surrounding the listening area, the processor comprising input signal conditioning and matrixing circuits, a control voltage generator responsive to the directional information contained in the stereophonic source signals, and a variable matrixing circuit for generating appropriate loudspeaker feed signals to create the illusion of the sound field spreading around the listening area, the control voltage generator having improvements in performance and reduced circuit complexity and cost. An inexpensive width-modulated pulse oscillator provides means for varying the time constants applied to directional information signals to produce control voltage signals for varying the matrixing coefficients. A new duration stretching circuit ensures tracking of the control voltages. The log-ratio detector circuits for producing the directional information signals achieve improved performance using less expensive parts.

10 Claims, 10 Drawing Sheets

D401
CA3141E
D402
100
LD
R401
4.99K
OA401
TL074
R402
4.99K
OA402
TL074
D403
CA3141E
R405
150K
-15V
D404
CA
3141E
R406
4.99K
R409
330
R410
243K
104
OA405
LM324
$V_{LR}$
D405
CA3141E
D406
102
RD
R403
4.99K
OA403
TL074
R404
4.99K
OA404
TL074
D407
CA3141E
R407
4.99K
C401
10 NP
D408
CA
3141E
R408
150K
+15V
D409
CA3141E
D410
106
FD
R411
4.99K
OA406
TL074
R412
4.99K
OA408
TL074
D411
CA3141E
R415
150K
-15V
D412
CA
3141E
R416
4.99K
R419
330
R420
243K
110
OA410
LM324
$V_{FB}$
D413
CA3141E
D414
108
BD
R413
4.99K
OA407
TL074
R412
4.99K
OA409
TL074
D415
CA3141E
R417
4.99K
C402
10 NP
D416
CA
3141E
R418
150K
+15V
+5.4V
R704
100K
+15V
R901
2.37K
D901
IN
5232B
C901
330
+5.4V
D902
IN
5232B
C902
330
R902
2.37K
-15V
-5.4V
D701
IN4148
R702
4.99K
R703
243K
U701
4584B
R701
3.3M
U702
4584B
C701
220P
S701
CD4053A
R705
100K
PULSE
OUT
C702
.001
R706
2.37K
-5.4V

CONTROL VOLTAGE GENERATOR FOR SURROUND SOUND PROCESSOR

CROSS REFERENCE TO RELATED APPLICATIONS

This application is a continuation-in-part of co-pending patent application Ser. No. 07/533,091, entitled "Surround Processor," filed Jun. 8, 1990, now U.S. Pat. No. 5,172,415, hereby incorporated by reference as if reproduced in its entirety.

TECHNICAL FIELD

The present invention relates in general to processors for the periphonic reproduction of sound. More specifically, the invention relates to improvements in the servologic control voltage generator of a surround sound processor for multichannel redistribution of audio signals.

BACKGROUND OF THE INVENTION

A surround sound processor operates to enhance a two-channel stereophonic source signal so as to drive a multiplicity of loudspeakers arranged to surround the listener, in a manner to provide a high-definition soundfield directly comparable to discrete multitrack sources in perceived performance. An illusion of space may thus be created enabling the listener to experience the fullness, directional quality and aural dimension or "spaciousness" of the original sound environment. The foregoing so-called periphonic reproduction of sound can be distinguished from the operation of conventional soundfield processors which rely on digitally generated time delay of audio signals to simulate reverberation or "ambience" associated with live sound events. These conventional systems do not directionally localize sounds based on information from the original performance space and the resulting reverberation characteristics are noticeable artificial.

To accomplish this end, a surround sound processor typically comprises an input signal conditioning and matrix circuit, a control voltage generator and a variable matrix circuit.

The input conditioning and matrix circuit usually provides for balance and level control of the input signals, generates normal and inverted polarity versions of the input signals, plus sum and difference signals, and in some cases generates phase-shifted versions thereof, and/or filters the signals into multiple frequency ranges as needed by the remainder of the processing requirements.

The control voltage generator typically includes a band-pass filter circuit, a directional detector circuit, and a servologic circuit. The band-pass filter circuit shapes the frequency response of the signals applied to the directional detector circuit so that this circuit responds similarly to the human ear. The directional detector measures the correlations between the signals which represent sounds encoded at different directions in the stereophonic sound stage, generating voltages corresponding to the directional location of the predominant sound. The servologic circuit uses these signals to develop control voltages for varying the gain of voltage controlled amplifiers in the variable matrix circuit in accordance with the sound direction and the direction in which it is intended to reproduce the sound in the surrounding loudspeakers.

The variable matrix circuit includes a number of voltage-controlled amplifiers and a separation matrix. The voltage-controlled amplifiers amplify the input matrix audio signals with variable gain, for application to the separation matrix, where they are used to selectively cancel crosstalk into different loudspeaker feed signals. The separation matrix combines the outputs of the input matrix and of the voltage-controlled amplifiers in several different ways, each resulting in a loudspeaker feed signal, for a loudspeaker to be positioned in one of several different locations surrounding the listener. In each of these signals, certain signal components may be dynamically eliminated by the action of the detector, control voltage generator, voltage-controlled amplifiers (VCA's) and separation matrix.

In U.S. Pat. No. 5,172,415 entitled "Surround Processor", Fosgate discloses a servologic control voltage generator which employs a width-modulated pulse train to vary the time constants applied to the control signals, in accordance with the difference between the raw detector output signals and the smoothed control signals resulting after they have been passed through the variable time-constant filters, thereby placing the modulating elements within a feedback loop, as shown in FIGS. 5–7 of that application and FIGS. 3, 4, 6 and **9*b*** herein.

In U.S. Pat. No. 4,932,059, Fosgate discloses use of variable time constants operated by means of a width-modulated pulse train, the duty cycle of which is controlled by means of a signal level detector, and further by means of a one-shot responsive to signal "attacks". This one-shot is so designed that the output pulse duration is sufficiently long to ensure that the control signals reach their appropriate values fairly quickly, but is sufficiently short that very low transient intermodulation distortion occurs, such that the listener is unable to hear any artifacts in the decoding process. This scheme is described with reference to FIGS. 2–5, **6*a* and 6*b* of the above-referenced patent, and FIG. 5*b*** of co-pending application Ser. No. 07/789,529.

A time constant processing circuit is provided for smoothing directional information signals produced by a detector circuit with continuously variable time constants in order to generate one or more control voltage signals. The circuit is responsive to both the amplitude and the rate of change of the directional information signals, such that as the difference between each of the directional information signals and its corresponding control voltage signal increases, the value of the corresponding time constant decreases, so as to allow the control voltage signal to more closely follow the directional information signal.

Furthermore, if the difference between these signals increases beyond a certain threshold value, in co-pending application Ser. No. 07/789,529, the one-shot is triggered, and causes the time constants applied to all of the directional information signals to be reduced to the minimum value for a short, predetermined period of time, so that the control voltage signals rapidly catch up with the directional information signals from the directional detector circuit When the difference between the direction information signals and their corresponding control voltage signals decreases, the corresponding time constant increases so as to provide very smooth processing of the audio information.

Typically such large and fast changes in the direction information signals correspond with sudden attacks in the information presented to the surround processor.

While the use of such a one-shot is not essential, it has been shown to be more effective than relying only upon the normal action of the servo-logic processor itself, without this addition.

In the present invention, this one-shot is replaced by a new circuit which lengthens the duration of a detected signal direction change and which acts on a single pulse width modulator (PWM) circuit to reduce the time constants in both of a pair of variable time constant circuits responding to front-back and left-right directional information signals. This provides a more effective circuit with fewer components and lower cost, while improving the perceived performance of the surround sound processor.

In surround sound processors, much of the subtleties of the presentation are due to the characteristics of the direction detector and servologic circuit of the control voltage generator and of the VCA's. As these are further refined, the apparent performance becomes more transparent and effortless-sounding to the listener.

SUMMARY OF THE INVENTION

It is an object of the invention to provide an improved surround processor for the reproduction of sound from a stereophonic source in a manner comparable to a live presentation from multiple sources in perceived performances.

It is another object of the present invention to provide a surround processor of the above type which provides faster but smoother and more realistic multichannel sound redistribution from a stereophonic source.

It is another object of the present invention to simplify and improve the circuitry previously used in the control voltage generator of a surround sound processor of the above type.

In accordance with these and other objects, the present invention relates in particular to improvements in the implementation of the circuitry of a servologic control voltage generator, and the inclusion therein of a new duration stretching circuit operating upon a single PWM system for simultaneously varying the time constants imposed upon both left-right and front-back directional information signals.

Furthermore, the present invention incorporates an improvement in the design of a pair of log-ratio detectors used for producing these directional information signals.

Another aspect of the invention relates to improved performance of the servologic circuit with regard to directional information signals arising from predominant sound directions in intermediate positions between the principal left-right and front-back axes, by combining the error signals derived from these directional information signals before generating the PWM control signal for varying the aforementioned time constants. This circuit has both improved performance and reduced complexity relative to previous implementations of the servologic control voltage generators described in the referenced co-pending patent applications.

In another aspect, the present invention provides an improved pulse width modulation circuit having a larger range of duty cycle variation.

BRIEF DESCRIPTION OF THE DRAWINGS

The novel features believed characteristic of the present invention are set forth in the appended claims. The invention itself, as well as other features and advantages thereof, will best be understood by reference to the following detailed description of an illustrative embodiment when read in conjunction with the accompanying figures, wherein:

DETAILED DESCRIPTION OF THE INVENTION

Figure 1:
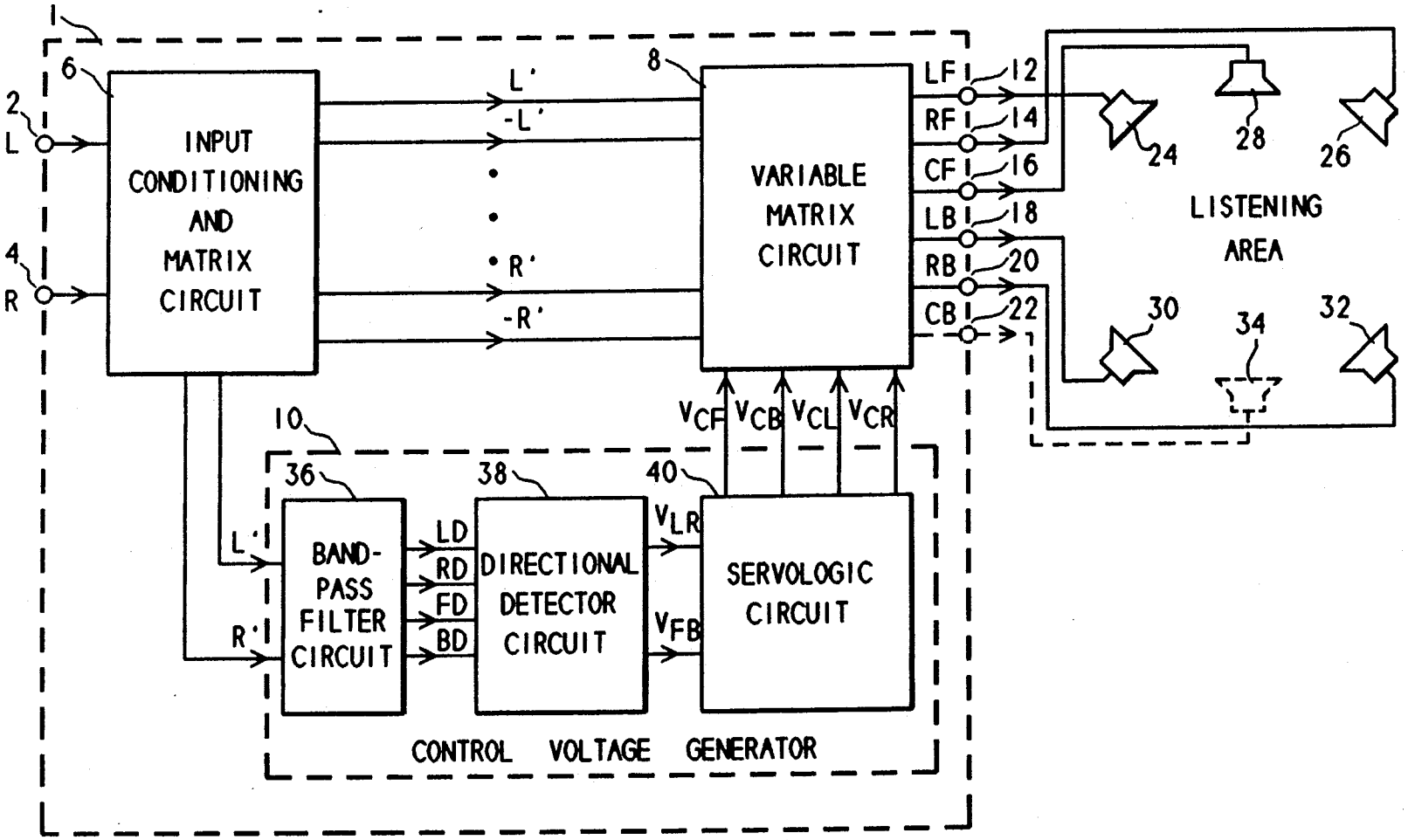
FIG. 1 is a block diagram which illustrates a surround sound processor involving the present invention.

Referring to FIG. 1, which illustrates the block schematic of a surround sound processor 1, a pair of audio input signals labeled L and R for left and right channel signals from a stereophonic source are respectively applied to input terminals 2 and 4 of the processor 1.

An input conditioning and matrix circuit 6 receives these signals and processes them for application to subsequent circuitry. This input matrix circuit 6 may contain user-adjustable level and balance controls for providing correctly balanced signals at an appropriate level for driving the remaining circuitry, automatic balancing circuitry for maintaining correctly balanced signals, a user-variable panorama control circuit for varying the effective width of surround sound presentation of the sounds being reproduced, and matrixing circuitry for providing suitable combinations of the conditioned input signals, these combinations being referred to as combination audio signals, to the variable matrixing circuit 8 and servologic control voltage generator circuit 10. The combination audio signals produced by this circuit are labeled L', −L, R' and −R', and in practice additional combination audio signals may be provided, represented by the elision dots between the lines labeled −L' and R'.

The variable matrixing circuit 8 combines the combination audio signals received from the input conditioning and matrix circuit 6 in fixed and varying proportions to provide a set of output signals labeled LF, RF, CF, LB, RB and optionally CB at corresponding terminals 12–22 for application via suitable power amplification (not shown) to a set of loudspeakers 24–34 arranged around a listening area substantially as shown, so as to provide the desired effect of sound surrounding the listeners. Loudspeaker 34 and the connections to it via terminal 22 may be omitted in some systems, as indicated by rendering these elements in broken lines. Although not shown in FIG. 1, outputs may also be provided for left and right side loudspeakers, and for subwoofers at various locations.

The varying proportions of the combination audio signals produced by input conditioning and matrix circuit 6 used in variable matrixing circuit 8 are determined by several control voltage signals labeled $V_{CF}$, $V_{CB}$, $V_{CL}$, and $V_{CR}$, which are provided by the servologic control voltage generator circuit 10 in response to input signals thereto labeled L' and R', produced by input conditioning and matrix circuit 6. The effect of combining the combination audio signals in such varying proportions is to cancel out unwanted signals from each of the output signals of the processor 1 so as to provide each loudspeaker 24–34 with appropriate signals corresponding to the direction of that loudspeaker relative to the listening area, to create the impression of a sound field expanded to surround the listener. The degree of such expansion may be altered by the listener as desired, by use of the panorama control mentioned previously as an optional component of input conditioning and matrix circuit 6.

The control voltage generator 10 comprises three sections of circuitry; a band-pass filter circuit 36, a directional detector circuit 38 and a servologic circuit 40. The signals L' and R' from the input conditioning and matrix circuit 6 are filtered by the band-pass filter circuit 36 and are also combined therein to produce four current signals labeled LD, RD, FD and BD. The bandpass filter circuit 36 has been described in detail in copending application Ser. No. 07/789,529 with reference to FIG. 2 of that application. No further description of this band-pass filter circuit will be given here, as the present invention does not involve any changes or alternative circuitry to that shown therein.

The current signals LD, RD, FD, and BD are applied to the directional detector circuit 38 where they are compared to produce a pair of directional information signals labeled $V_{LR}$ and $V_{FB}$. The directional detector circuit comprises a pair of log-ratio detectors, which compare the LD and RD signals to produce the directional information signal $V_{LR}$, and similarly compare the FD and BD signals to produce the directional information signal $V_{FB}$.

The servologic circuit 40 acts to smooth these signals $V_{LR}$ and $V_{FB}$ with variable time constants, and to generate from them four control voltage signals labeled $V_{CF}$, $V_{CB}$, $V_{CL}$, and $V_{CR}$, which are applied to the variable matrix circuit 8.

Figure 2:
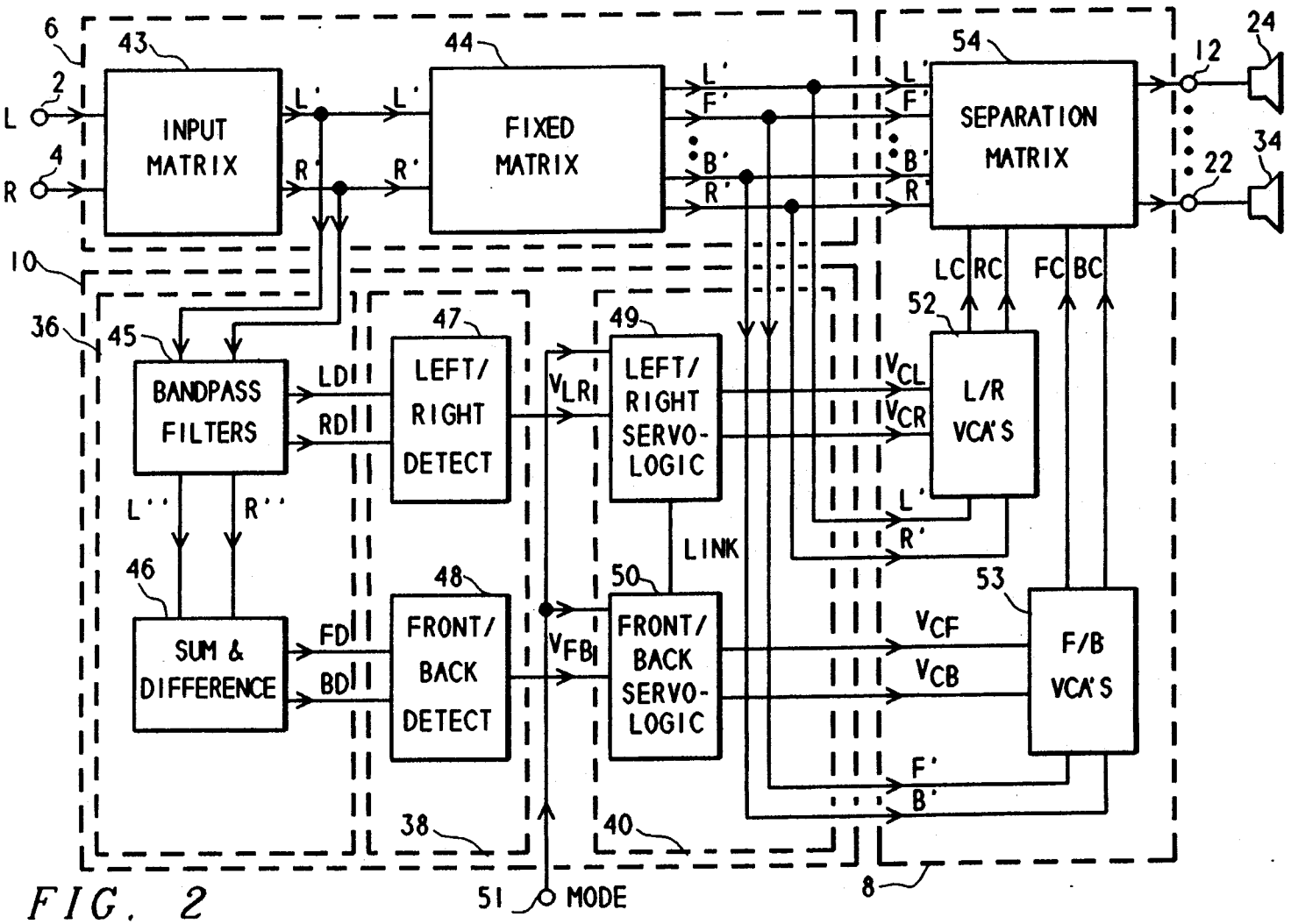
FIG. 2 is a block diagram illustrating the processor of FIG. 1 in more detail.

Referring to FIG. 2, which illustrates a more detailed block schematic of the circuit of FIG. 1, it will be seen that the input conditioning and matrix circuit 6 comprises an input conditioning circuit labeled 43 and a fixed matrix circuit labeled 44. As described previously, the input conditioning circuit 43 combines the audio input signals L and R applied to its input terminals 2 and 4 by means of an optional panorama control, amplifies them to suitable maximum levels for application to following circuits, and balances them manually and/or automatically for the optimum sound reproduction to be achieved. These conditioned signals are labeled L' and R' to distinguish them from the unmodified audio input signals L and R.

The signals L' and R' are matrixed in the fixed matrix circuit 44 to provide at least the combination audio signals L', R', F' and B' to following circuitry to be described below. In addition, the inverted versions of these signals, −L', −R', −F', and −B−, may be generated in circuit block 43. The possibility of these additional signals is depicted by elision dots between signal lines labeled F' and B'. The signals F' and B' are respectively the sum L'+R' and difference L'−R' of the signals L' and R', which are also passed unchanged by the circuitry of block 44.

The signals L' and R' from input conditioning circuit 6 are also connected to the inputs of the control voltage generator 10, which comprises the bandpass filter circuit 36, directional detector circuit 38 and servologic circuit 40. The first stage of the bandpass filter circuit 36 is bandpass filters circuit block 45, where the L' and R' signals are filtered with a frequency response approximating an inverse of the relationship between human aural sensitivity and frequency at the threshold of audibility, so as to make the action of the directional detector circuit 38 correspond more closely to the sensitivity characteristics of the human ear, as described in copending applications Ser. Nos. 07/533,091 and 07/789,529. The output signals are labeled L" and R" to distinguish them from the full bandwidth signals L' and R'. The final stages of these filters 45 convert the signals L" and R" from the bandpass circuits into current signals labeled LD and RD, via an additional pole of high-pass filtering.

The filtered signals L" and R" from the bandpass filter 45 are summed and differenced in sum and difference circuit 46 to produce internal sum and difference signals (not indicated), which are passed through an additional pole of high-pass filtering to produce current signals labeled FD and BD. This additional pole of filtering matches that used for the LD and RD signals.

The bandpass-filtered current signals LD, RD, FD and BD are applied to the directional detector circuit 38, comprising identical left/right detector 47 and front/back detector 48. The detectors 47 and 48 produce directional information signals $V_{LR}$ and $V_{FB}$ respectively.

These signals are in turn applied to the servologic circuit 40 which again comprises two identical circuits 49 and 50, labeled left/right servologic and front/back servologic respectively. A linkage between these circuits may be provided to force both circuits to respond quickly when sudden changes in directional information are sensed by either circuit. Additionally, although not shown, some elements of the circuitry may be shared by both of the servologic circuits 49 and 50.

The servologic circuits 49 and 50 may optionally be switched to a different mode of operation required for reproduction according to the Dolby Laboratories Ltd. Pro-Logic system by means of a signal applied to terminal 51 provided for mode selection. In this mode of operation, two different smoothing time constants are selected depending upon the absolute magnitudes of the directional information signals $V_{FB}$ and $V_{LR}$.

Each of these servologic circuits 49, 50, provides a pair of output signals which are the control voltage signals mentioned previously. The left/right servologic circuit 49 generates control voltage signals $V_{CL}$ and $V_{CR}$ from the directional information signals $V_{LR}$, while the front/back servologic system 50 generates the control voltages $V_{CF}$ and $V_{CB}$ from the directional information signal $V_{FB}$.

The signals L', R', F' and B' and their inverted forms from the fixed matrix circuit 44 are applied to the inputs of the variable matrixing circuit 8. As described in copending application Ser. No. 07/533,091, this circuit comprises a set of voltage controlled amplifiers (VCA's) and a number of summing amplifiers commensurate with the number of loudspeakers to be used for reproduction of the sound.

The VCA's are shown in two pairs, represented by the circuit blocks 52, labeled L/R VCA's, and 53, labeled F/B VCA's. The L/R VCA's 52 actually comprise a left VCA controlled by the control voltage signal $V_{CL}$, with an input signal L', and a right VCA controlled by the control voltage signal $V_{CR}$, with an input signal R'. Similarly, the F/B VCA's 53 comprise a front VCA controlled by the control voltage signal $V_{CF}$ for variably amplifying the input signal F' derived in the fixed matrix circuit 44, and a back VCA controlled by the control voltage signal $V_{CB}$ to amplify the signal B' from the fixed matrix circuit 44.

The output signals from the left, right, front and back VCA's respectively are labeled LC, RC, FC and BC, and are the cancellation audio signals which are applied to the separation matrix circuit 5 forming part of the variable matrix circuit 8. The combination audio signals L', R', F' and B', and their inverses, −L', −R', −F', and −B', are also applied to this separation matrix circuit 54. Each of the summing amplifiers making u the separation matrix circuit 5 combines fixed proportions of these combination audio signals with appropriate proportions of the cancellation audio signals, which are variably amplified or attenuated versions of the combination audio signals −L', −R', −F' and −B', as the VCA's are typically in an inverting configuration.

When a predominantly left channel signal is presented to the inputs 2, 4 of the surround sound processor 1, for example, the left/right servologic circuit 49 produces a control signal $V_{CL}$ of maximum value, causing the left VCA in circuit block 52 to have its maximum gain, while the other three control voltages are zero, and the gains of the other three VCA's are also zero. The cancellation audio signal LC is made equal to −L', and is applied to cancel out the L' signals in summing amplifiers of circuit block 54 for all loudspeaker output audio signals other than left front (LF) and left back (LB) (see FIG. 1), so that the resultant sound appears to the listener to come from the left side of the listening area. The cancellation audio signal LC may also be added into the LF and LB output audio signals to maintain the correct overall sound pressure level in the listening area, which might otherwise be reduced by the cancellations occurring in the other loudspeakers. Furthermore, the relative levels of LF and LB output audio signals may depend upon the optional panorama control position and upon the particular levels of augmentation of these signals as selected by the user through switchable mode options (not shown) for a wide or narrow surround sound spreading effect.

Similar considerations apply when any of the other three control voltage signals reach their maximum values, forcing the sound field generated to conform with the desired surround sound effect.

When signals containing predominant sound directions other than the principal directions of precisely left, right, front or back, are applied to the surround sound processor 1, two of the four control voltage signals assume values less than their maximum values, causing the effective cancellation of the sound from loudspeakers generally opposite to or flanking the intended localization, while maximizing the output of loudspeakers generally in the direction of the intended localization for the predominant sound. This ensures that the listener will receive an impression of the sound apparently coming from the intended direction. The performance of a surround processor with signals from other than the principal directions will be discussed later with reference to FIG. 8.

While most surround sound processors of the variable matrixing type perform similar operations on the signals and achieve high separation of predominant signals when the predominant direction varies only slowly, more typically the predominant signals change from instant to instant, causing the control voltage signals to vary in accordance with the changes of predominant sound direction. Consequently, for realistic sound reproduction, it is necessary for the dynamic variations of directional information content of the audio input signals to be tracked and followed closely by the servologic control voltage generator, yet without imposing artifacts on the surround sound presentation. Such artifacts are often present and have been described as "breathing", "warbling", and other forms of instability of the sound image, and transient intermodulation distortion effects.

Figure 3:
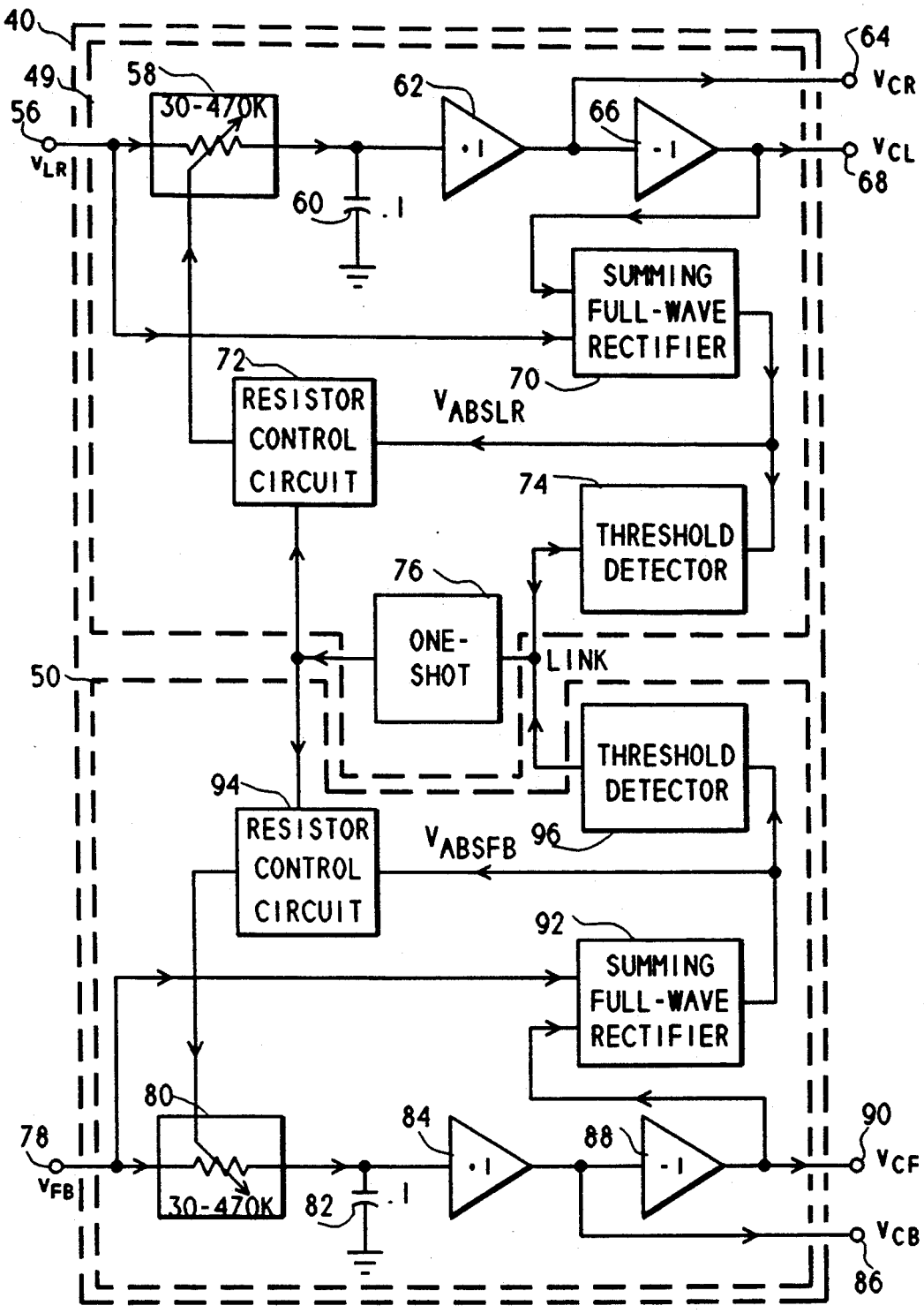
FIG. 3 is a block schematic of a servologic circuit of a control voltage generator of the processor of FIG. 1, according to co-pending application Ser. No. 07/789,529.

Referring to FIG. 3, which illustrates a block schematic of a servologic circuit 40 according to the copending applications Ser. Nos. 07/533,091 and 07/789,529, this comprises two essentially identical sections 49 and 50. In circuit 49, the directional information signal $V_{LR}$ is applied via terminal 56 to a variable resistance element 58 which forms a variable time constant with capacitor 60. The voltage appearing on capacitor 60 is a smoothed version of the directional information signal $V_{LR}$, and is buffered by a unity gain buffer 62 to produce a control voltage signal $V_{CR}$ at terminal 64. This signal is inverted by a unity gain inverter 66 to produce a second control voltage signal $V_{CL}$ at terminal 68.

The directional information signal $V_{LR}$ and the control voltage signal $V_{CL}$ derived therefrom are applied to a summing full-wave rectifier 70, which adds them to produce, in effect, the difference between $V_{LR}$ and $V_{CR}$, since $V_{CL}$ is the negative of $V_{CR}$. Full-wave rectifier circuit 70 also rectifies this difference signal to provide a voltage $V_{ABSLR}$ proportional to the absolute value thereof. This voltage is applied to a resistor control circuit 72, which varies the resistance of variable resistor element 58 in response to the signal $V_{ABSLR}$ in a manner to reduce the time constant as the magnitude of this signal increases.

When the time constant is reduced, the control voltage signal $V_{CR}$ follows the directional information signal $V_{LR}$ more closely, reducing the magnitude of the absolute difference signal $V_{ABSLR}$, thereby providing a negative feedback loop which is similar in concept to a servo loop, hence the circuit 49 is called a servologic circuit.

The absolute difference signal $V_{ABSLR}$ is also applied to a threshold detector 74, where it is compared with a fixed threshold voltage. Whenever the threshold voltage is exceeded, threshold detector 74 provides a trigger signal to a one-shot or monostable multivibrator circuit 76 which is shared by the second servologic circuit 50. When one-shot 76 is triggered, it produces a rectangular pulse of fixed duration which also acts on the resistor control circuit 72 or alternatively may act directly on the variable resistor element 58 reducing its resistance to its minimum value, shown as 30KΩ. The duration of the pulse from one-shot 76 is long enough to ensure that the control voltage signal $V_{CR}$ appearing at capacitor 60 has time to reach the instantaneous value of directional information signal $V_{LR}$, that is, at least three times the minimum value of the time constant formed by variable resistor element 58 with capacitor 60, which is about 3 ms. It is also short enough to ensure that the unwanted audio artifacts associated with too rapid a time constant are not heard, as the time constant reverts to a much slower value immediately after the pulse from one-shot 76 ends, resulting in smooth control signal variations. The maximum resistance of variable resistor element 58 is typically 470KΩ, providing with capacitor 60 of 0.1μF a time constant of 47 ms.

In the similar servologic circuit 50, the directional information signal $V_{FB}$ is applied via terminal 78 through variable resistor element 80, to capacitor 82. The voltage across this capacitor 82 is buffered by unity gain buffer 84 to produce the control voltage signal $V_{CB}$ at terminal 86, and this signal is inverted by unity gain inverter 88 to produce a control voltage signal $V_{CF}$ at terminal 90.

The directional information signal $V_{FB}$ and the control voltage signal $V_{CF}$ are applied to a second summing full-wave rectifier 92, which produces the absolute difference signal $V_{ABSFB}$ and applies it to both the resistor control circuit 94 and threshold detector 96. The resistor control circuit 94 controls the resistance of variable resistor element 80 and the threshold detector 96 also applies trigger pulses to the shared one-shot 76. The output pulses from this one-shot 76 are also applied to the resistor control circuit 94 or directly to variable resistor element 80, to reduce its resistance to the minimum value and thereby permit the control voltage signal $V_{CB}$ to catch up with the value of the directional information signal $V_{FB}$.

Thus, whenever either threshold detector 74, 96, indicates that a rapid change in directional information is occurring, the one-shot 76 is triggered, and its output pulse ensures that both sets of control voltages catch up to their related directional information signal, thereby directing the sound signals into the appropriate combination of loudspeakers for correctly reproducing the sound in the desired direction relative to the listening area.

Figure 4:
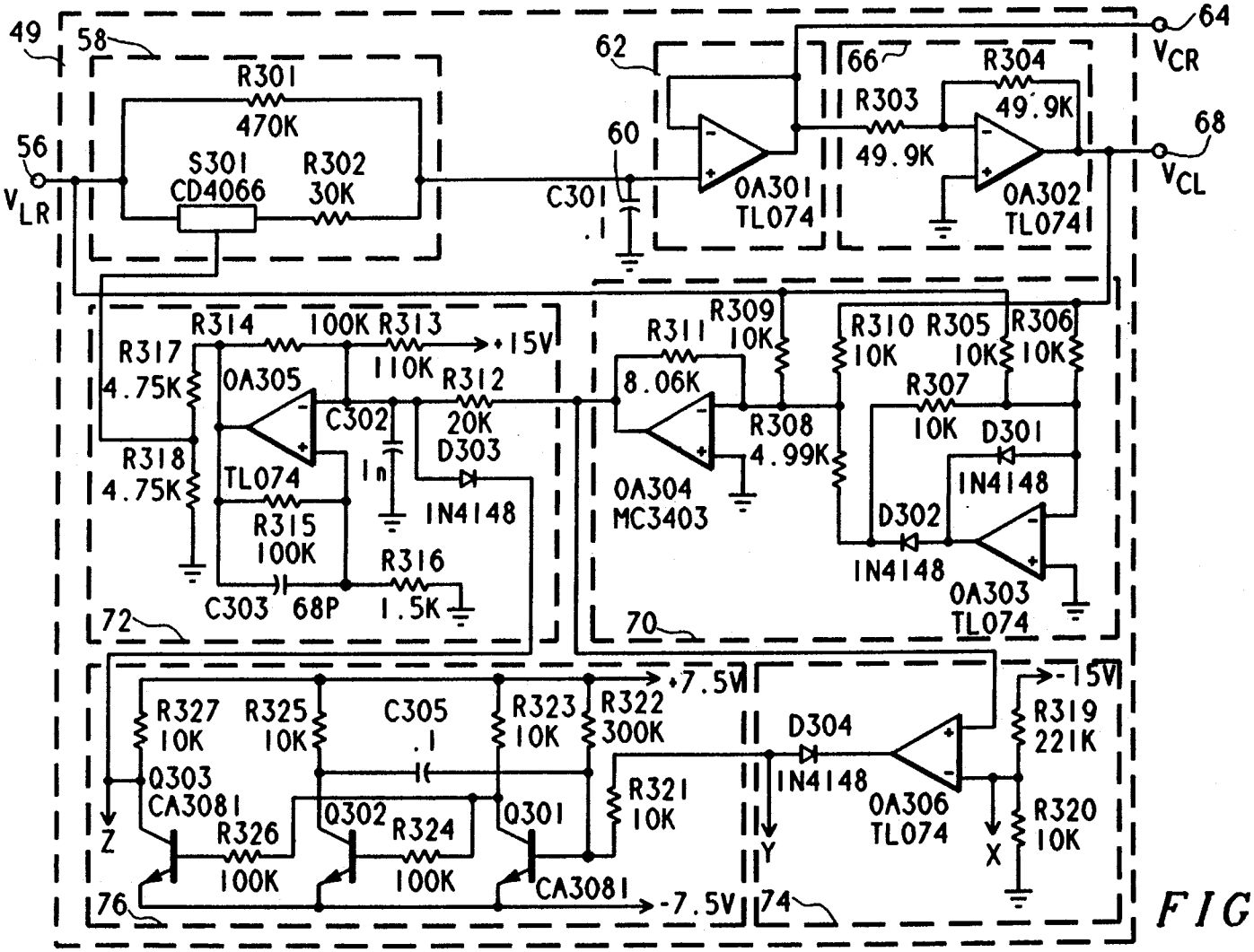
FIG. 4 is a detailed schematic of a servologic circuit of the control voltage generator of FIG. 3.

Turning now to FIG. 4, which illustrates an embodiment of this servologic circuit according to co-pending application Ser. No. 07/789,529 and is shown therein as FIG. 7, the various circuit elements of servologic circuit are shown in detail. The signal $V_{LR}$ is applied to terminal 56 and thence to the variable resistor element 58. This comprises a CMOS switch element S301, in conjunction with fixed resistors R301 and R302. Although shown with a resistor R301 in parallel with a series combination of switch S301 and resistor R302, alternatively resistor R301 ma be in parallel with the switch S301 only, and resistor R302 in series with this combination, without altering the function of this circuit block.

Following this variable resistor element 58, a capacitor C301 is identified with capacitor 60 of FIG. 3. The voltage thereon is buffered by a source follower operational amplifier OA301 which forms unity gain buffer 62, and an inverter 66 comprising operational amplifier OA302 with resistors R303 and R304 to define a gain of unity. The outputs of buffer 62 and inverter 66 are available at terminals 64 and 68 respectively, to provide the control voltage signals $V_{CR}$ and $V_{CL}$ to following circuitry.

The summing full-wave rectifier circuit 70 comprises operational amplifiers OA303 and OA304 with associated resistors R306–R311 and diodes D301 and D302, in a conventional circuit, producing a negative-going absolute value signal proportional to the difference between an $V_{LR}$ and $V_{CR}$. The gain is defined by resistor R311, and the output is limited to ±6V approximately by supplying operational amplifier OA304 from reduced supply voltages (not shown.)

The absolute difference signal $V_{ABSLR}$ is applied to the resistor control circuit 72, which is a pulse oscillator formed by operational amplifier OA305 and its associated resistors R312–R318 and capacitors C302 and C303. This oscillates with a duty cycle that increases as the absolute difference signal applied to resistor R312 goes negative, reaching a duty cycle of 1 when this voltage goes below about −5V. The output pulses from this circuit 72 are attenuated by resistors R317 and R318 to an appropriate level to drive the CMOS switch S301 in variable resistor element 58. When the duty cycle is zero, switch S301 is off, and the time constant due to R301 and C301 is about 47ms. When the duty cycle is 1, the switch S301 is continuously on, and the time constant is reduced to a minimum value of about 2.8ms due to the parallel combination of resistors R301 and R302 with capacitor C301.

The lower part of FIG. 4 shows the threshold detector 74 which comprises operational amplifier OA306 with biasing resistors R319 and R320 to set the threshold voltage (which is also applied to the same point of the second threshold detector 96, not shown, through the line labeled X.) The output of the threshold detector is applied through diode D304 to the one-shot 76. A similar diode in threshold detector 96 is connected to point Y to effect triggering of the sam one-shot 76 when the other threshold detector 96 operates.

The one-shot 76 comprises transistors Q301–Q303 with capacitor C304 and resistors R321–R327. Its output pulse width is defined by resistor R322 with capacitor C304, and the pulse is applied via diode D303 to the resistor control circuit 72, forcing the voltage on capacitor C702 negative to drive the duty cycle to 1 for the duration of the pulse. The other resistor control circuit 94 of FIG. 3 is driven from point Z through a similar diode in resistor control circuit 94.

Thus the circuit of FIG. 4 implements the operational requirements of a servologic circuit according to the block schematic of FIG. 3. While this circuit has proved to be very satisfactory, it is expensive in terms of components, and therefore an alternative and less expensive embodiment is to be described below with reference to FIG. 6. In this new embodiment, a number of improvements are also made, which affect the performance of the servologic circuit advantageously.

Figure 5:
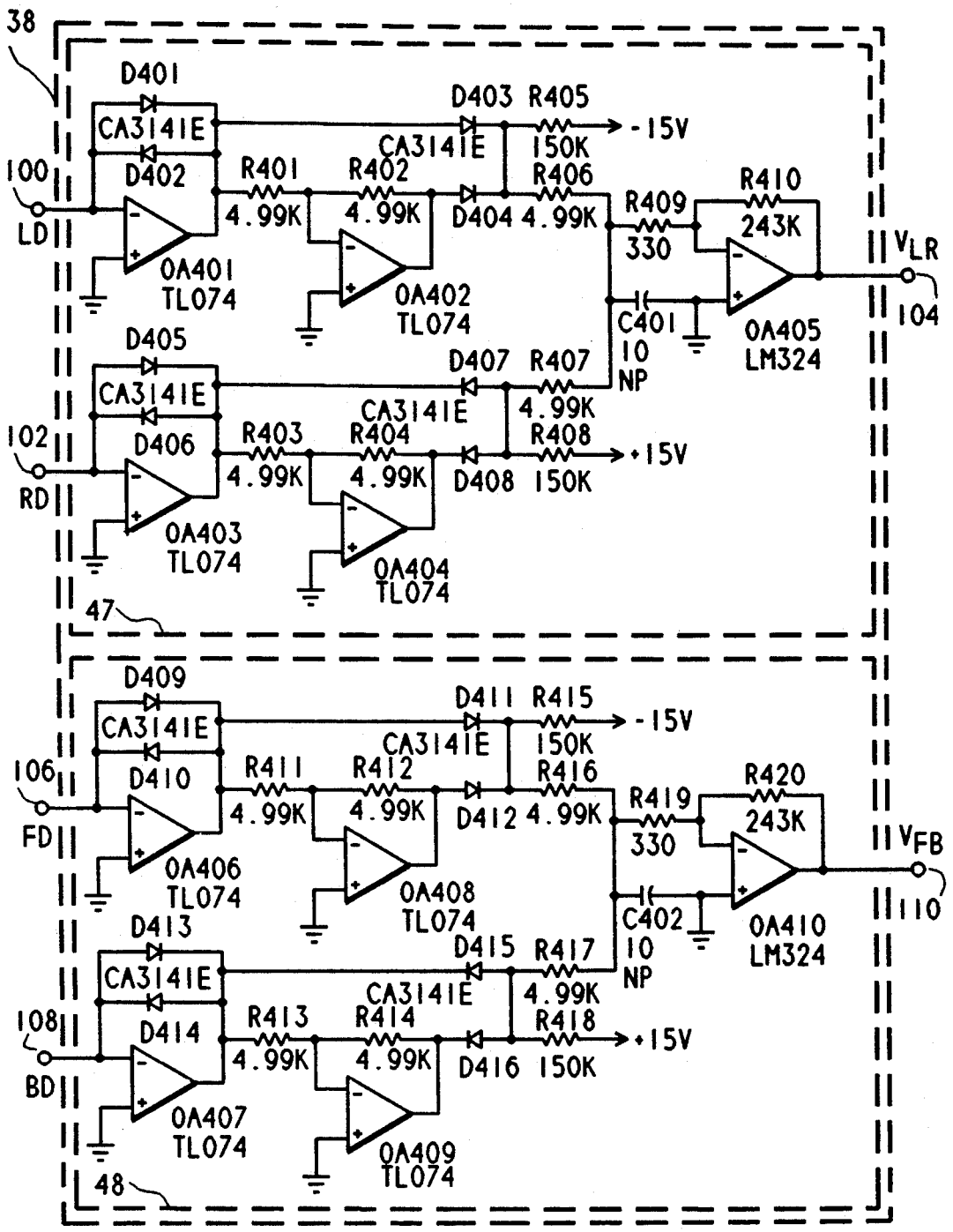
FIG. 5 is a detailed schematic of a log-ratio detector circuit of the processor of FIG. 1 according to the present invention.
Figure 6:
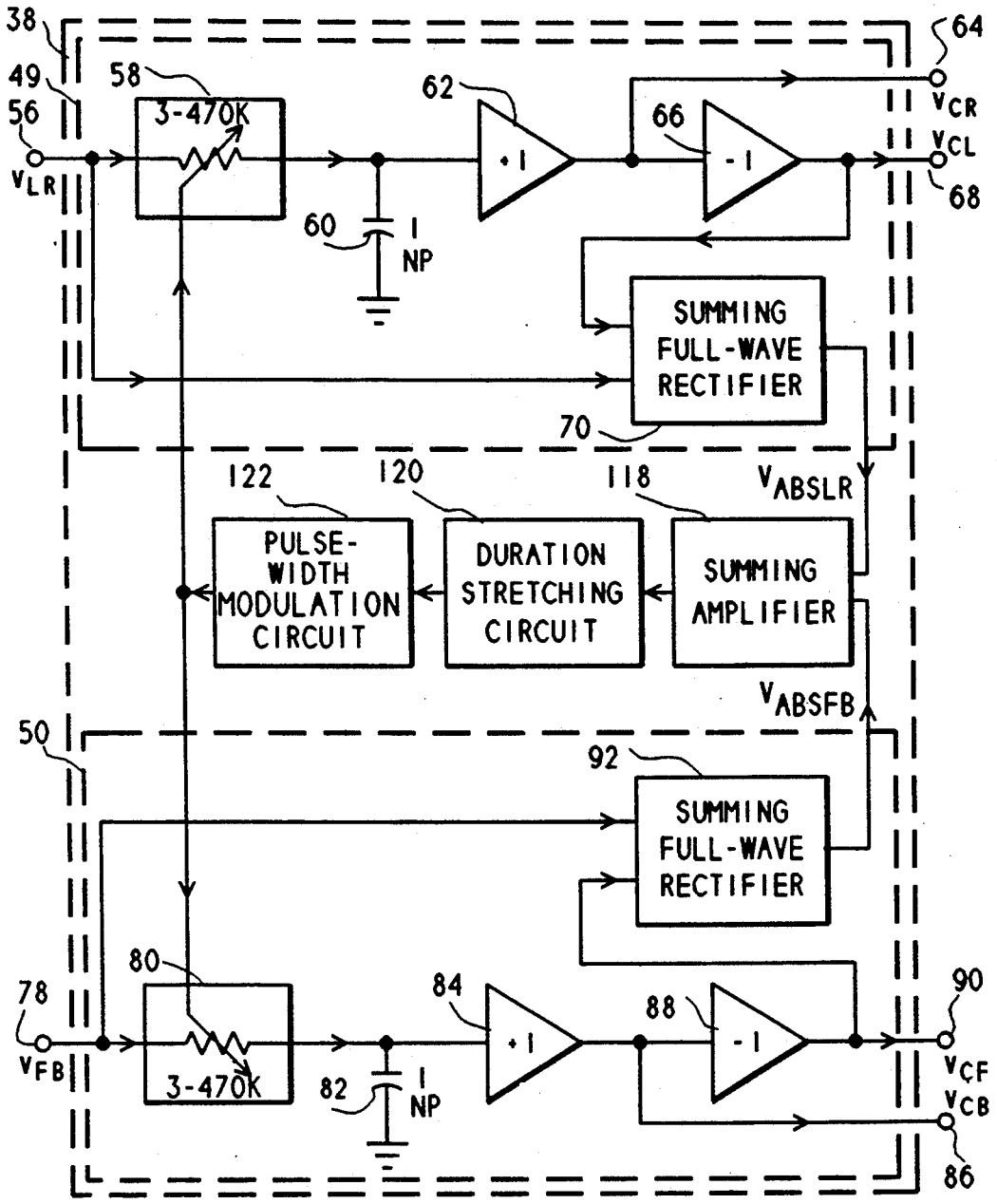
FIG. 6 is a block schematic of a servologic circuit of a control voltage generator of the processor of FIG. 1, according to the present invention.

Before discussing the circuitry of FIG. 6, however, it is necessary to note that improvements have been made to the log-ratio detector circuitry forming circuit block 38 of FIGS. 1 and 2. This circuitry is shown in detail in FIG. 5, which may be compared with FIG. 4 of co-pending application Ser. No. 07/589,729.

The direction detectors 47 and 48 of circuit block 38 are shown in FIG. 5. In the upper circuit 47, the current signals LD and RD are applied through terminals 100, 102 to the virtual ground inverting inputs of operational amplifiers OA401 and OA403 respectively. These amplifiers each employ a pair of matched diodes connected in antiparallel to provide an output voltage proportional to the logarithm of the input current. Diodes D401 and D402 provide the feedback path of amplifier OA401, and diodes D405 and D406 provide feedback for amplifier OA403. Typically, diodes D401, D402, D405, and D406 are from a single integrated circuit diode array of industry type CA3141E to ensure close matching of their characteristics. The non-inverting inputs of amplifiers OA401 and OA403 are grounded. These amplifiers may b=, for example, sections of a quad BiFET operational amplifier of industry type TL074 for economy.

The output voltages from amplifiers OA401 and OA403 are inverted by operational amplifiers OA402 and OA404 respectively, each of these having a pair of 4.99KΩ input and feedback resistors which are closely matched to make the inverter gains precisely unity. Amplifier OA402 employs input resistor R401 and feedback resistor R402, and amplifier OA404 has input resistor R403 and feedback resistor R404.

Diodes D403 and D404 provide positive rectification of the output voltages from amplifiers OA401 and OA402, while diodes D407 and D408 negatively rectify the output of amplifiers OA403 and OA404. Resistors R405 and R408 apply forward bias to diode pairs D403, D404 and D407, D408 respectively, and the rectified output voltages are applied via resistors R406 and R407 respectively to a smoothing capacitor C401. The voltage on this capacitor thus is proportional to the average of the difference between the amplitude of the signals appearing at the outputs of amplifiers OA401, OA402, and the amplitude of the signals at the outputs of amplifiers OA403, OA404. Since the diodes in the feedback circuits of amplifiers OA401 and OA403 perform a logarithmic function on the input currents LD, RD, received at terminals 100, 102, this voltage therefore represents the logarithm of the ratio of left to right information present in the input signals L', R', to the control voltage generator 10, as weighted by the bandpass filter circuit 36 of FIG. 1.

This signal is amplified by a fifth operational amplifier OA405, with input resistor R409 and feedback resistor R410 chosen to yield the desired gain, producing the directional information signal $V_{LR}$ at its output terminal 104.

The directional detector 48 in the lower half of FIG. 5 is of identical design, and need not be described further. It receives the current signals FD and BD at terminals 106 and 108, and provides the directional information signal $V_{FB}$ at the output terminal 110.

In the circuit of FIG. 4 of co-pending application Ser. No. 07/789,529, the circuit topology was identical, but high performance operational amplifiers types AD712 and NE5532 were used in the log amplifiers and inverters respectively. In the present embodiment, designed for low cost, these amplifiers are all of industry type TL074, and resistors R401–R404 have changed from 1.00KΩ to 4.99KΩ, resulting in very slightly poorer performance in this part of the circuit. However, the present embodiment shown in FIG. 5 has advantages over the previous circuit.

Again, in FIG. 4 of the previous application, the resistors R406, R407 and R409 are each 4.75KΩ, and the capacitor C401 is 2.2μF. In the new embodiment shown here, resistors R406 and R407 are each 4.99KΩ, but capacitor C401 has increased to 10μF and resistor R409 has been reduced to 330Ω. This change has the effect of reducing the magnitude of the voltages appearing at capacitor C401 and hence reducing the effect of either rectifier circuit on the other. Previously, the time constant for averaging was determined by all three resistors R406, R407 and R409 in parallel, with capacitor C401, to give a time constant of about 3 ms. The same is true of the present circuit, but now that time constant is dominated by the effect of resistor R409 and capacitor C301, so that the precise values of R406 and R407 have much less effect, although they must be matched.

Thirdly, the biasing of the diodes through resistors R405 and R408 has been increased, as these resistors changed to 150KΩ from 432KΩ. This improves the performance of the detector when low signal levels are present.

Fourthly, in the previous embodiments, the amplifier OA405 was typically a MC3403 type operating at reduced supply voltages of ±7.5V, for the purpose of limiting the maximum output swing. In the present embodiment, an cheaper LM324 amplifier type is used, and run from the ±15V supplies used for the other operational amplifiers. The limiting function is instead provided after this amplifier.

Referring to FIG. 6, which shows a block schematic of a servologic circuit according to the present invention, the log ratio detector output signals $V_{LR}$ and $V_{FB}$ are applied to terminals 56 and 78 respectively as in the circuit of FIG. 3. The values used for capacitors 60 and 82 have been changed to 1μF from 0.1μF, but the minimum resistance of variable resistor elements 58 and 80 has been reduced to 3KΩ from 30KΩ so that the shortest time constant is still 3 ms, but the longest possible time constant is now 470 ms. The buffers 62 and 84, inverters 66 and 88, and the full-wave rectifiers 70 and 92 are similar to those previously described. However, the output currents from these rectifier circuits are now summed into a single operational amplifier 118, the output of which is used to drive a novel duration stretching circuit 120 and pulse width modulation circuit 122, forming the single resistance control circuit which varies both variable resistance elements, 58 and 80, together.

Figure 7:
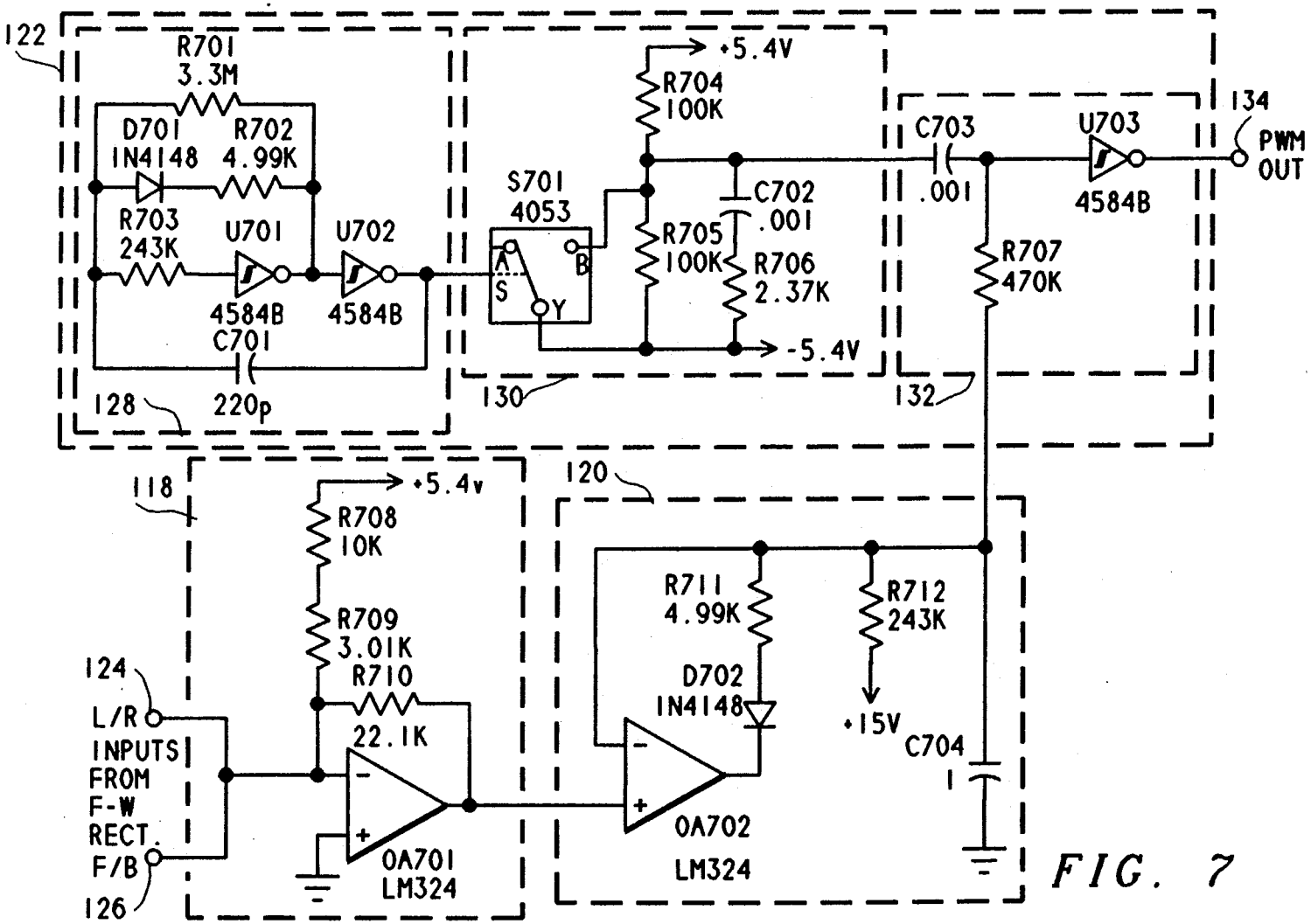
FIG. 7 is a detailed schematic of a pulse width modulation circuit and error signal duration stretching circuit of the servologic circuit of FIG. 6.

Referring to FIG. 7, which shows a duration stretching circuit 120 and a new pulse width modulator circuit 122 in detail, with the amplifier 118 also shown, by comparison with the summing full-wave rectifier circuit shown in FIG. 4, amplifier 118 replaces both amplifiers OA304 of that circuit. The resistors equivalent to R308, R309 and R310 of rectifier 70 are connected to terminal 124, and those of rectifier 92 of FIG. 4 are connected to terminal 126, so that the rectifier outputs are summed in common to the buffer amplifier OA701, with feedback resistor R710. A potentiometer R708 and resistor R709 are used to apply a d.c. offset to the amplifier output for adjustment of the PWM bias point.

The output of amplifier OA701 drives the duration stretching circuit 120, which is effectively a negative peak follower with a slow decay time. This circuit comprises an operational amplifier OA702 with diode D702, resistors R711 and R712, and capacitor C704. During negative excursions of the rectifier output, the amplifier output is driven negative, charging capacitor C704 through resistor R711 and diode D702, with a time constant on the order of 5 ms. When the rectifier output from amplifier OA701 goes more positive, the output of amplifier OA702 goes to the positive rail and cuts off diode D702, and capacitor C704 slowly charges to a more positive voltage through resistor R712, which is returned to the +15V supply voltage. This charging is almost linear over the range of voltages possible at C704, and has a time constant of about 160 ms.

The pulse width modulator circuit 122 comprises an oscillator 128 made from MC14584B Schmitt trigger inverters U701 and U702, employing a feedback capacitor C701, with diode D701 and resistors R701–R703. This produces a positive-going train of pulses of about 3μs duration and 160μs period. These pulses are applied to the modulator 126 where they operate a CMOS switch S701 of industry type CD4053. This switch is applied to short-circuit a resistor R705, which with resistor R704 forms a bias chain such that the voltage at their junction is normally at ground potential. During the pulses, this voltage is pulled to the −5.4 V CMOS supply rail. In parallel with R705 is a series combination of capacitor C702 and resistor R706, and during the pulse capacitor C702 is discharged. When the pulse ends, the voltage on capacitor C703 rises initially steeply, then with an exponential curvature, discharging throughout the 160 μs period.

The pulses at the junction of resistors R704 and R705 are a.c. coupled by capacitor C703 to the input of another Schmitt trigger inverter U703, which is also biased by a resistor R707 from the output of the pulse stretcher 120. As this biases the input more negatively, the pulse waveform switches the inverter on for more of the total time, until the voltage on capacitor C704 is sufficiently negative to keep the output o inverter U703 positive continuously. Conversely, when the pulse stretcher output is close to zero, the inverter is switched on only for a very short duration of about 1.6 μs, or half the input pulse width. Thus the modulator has an effective duty ratio variation of about 100:1, which is considerably better than the range of approximately 33:1 available from the circuit shown in FIG. 4. Furthermore, the new circuit uses many fewer components, mostly cheaper CMOS active circuit elements, and it also consumes much less power than the previous embodiments.

Figure 8:
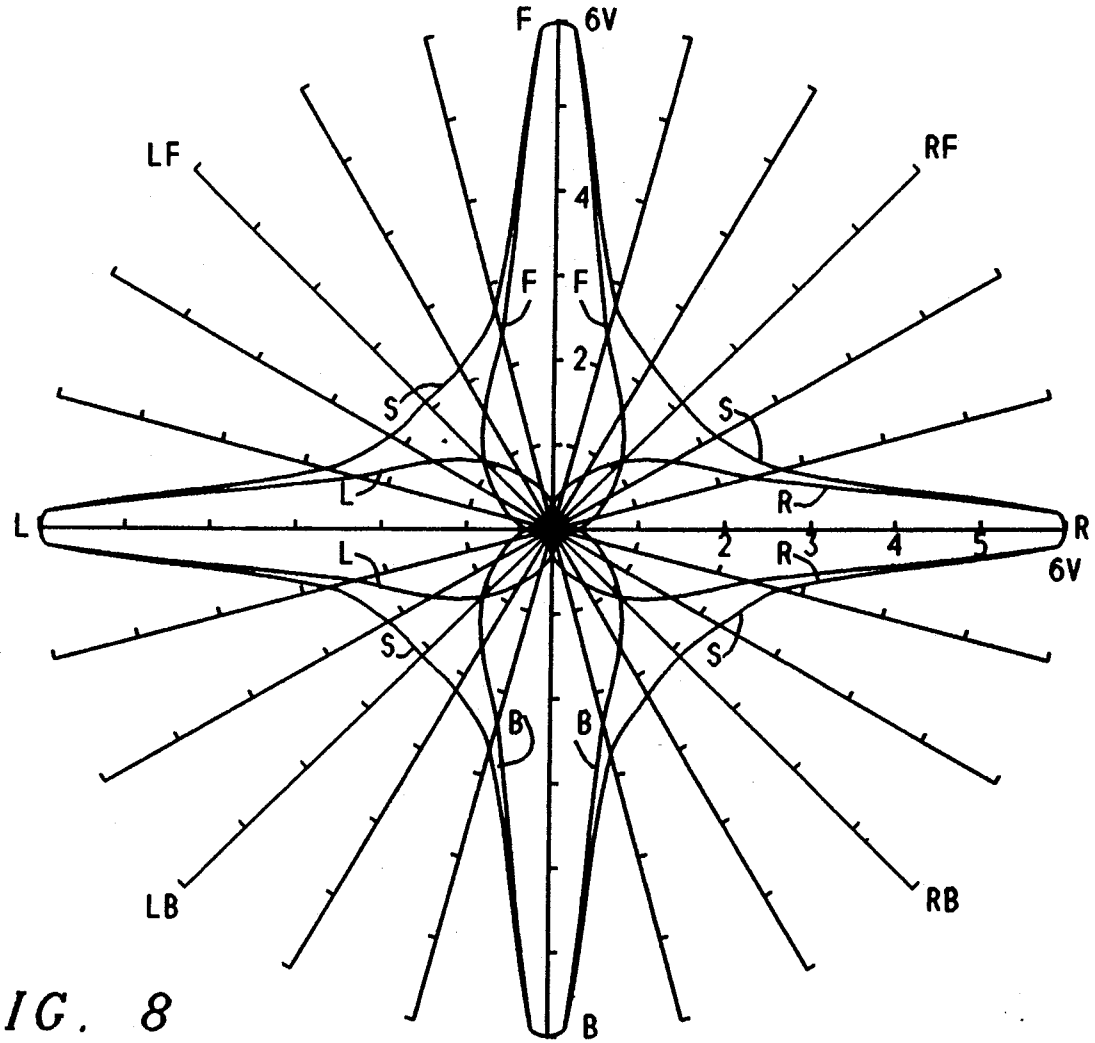
FIG. 8 is a diagram illustrating the performance characteristics of the detector circuit of FIG. 5 of the present invention in response to various predominant sound directions encoded in the input signals to the processor of FIG. 1.

FIG. 8 shows a plot of the four control voltage signals related to the encoded signal direction. The horizontal axis runs from direction L to direction R, and is calibrated at 1 V intervals, to represent the output of the L/R directional detector 47, which is the directional information signal $V_{LR}$. Similarly, the vertical axis between directions F and B is calibrated at 1 V intervals represent the directional information signal $V_{FB}$.

Also shown are ten additional axes at 15° intervals, which represent the intermediate directions in equal angular steps of the signal direction. The plane defined by axes FB and LR can be visualized as the horizontal or real plane of the energy sphere, as used by Scheiber, Gerzon, and others, to represent directions in encoded signal space. According to this convention, the amplitude ratio between left and right signals of a stereo pair for any intermediate direction 8 measured clockwise from the L direction on this graph is given by $\cot(\Theta/2)$, so that the L signal has a magnitude $E\cos(\Theta/2)$ and that of the R signal is $E\sin(\Theta/2)$. For signals in the lower half of the diagram, the angle $\Theta$ is negative, so the polarity of the right channel is reversed.

If a signal pair at position L is applied to the directional detector circuit 38 of FIG. 1, the control voltage signal $V_{CL}$ will have its maximum value, limited to 6 V. If the signal direction is ±15° from L, the control voltage signal $V_{CL}$ is reduced to about 2.4V as shown by the intersection of the curve labeled L with the pair of axes 15° above and below the LR axis. Similarly, at ±30° the control voltage signal $V_{CL}$ falls to about 1.6V, at ±45° it is about 1.1V, at ±60° it is about 700mV and at ±75° it has dropped to about 330 mV. For all other directions of ±90° or more from L, the $V_{CL}$ control signal is effectively zero. Actually, as shown in the detailed circuitry of FIGS. 3, 4, 6 and **9*b*, the $V_{CL}$ signal is negative for sound sources in the left side region and positive for sources in the right side region, but when positive it has no effect on the VCA circuit it controls, which only responds to negative-going signals. For the purpose of discussion of the control voltages with reference to FIG. 8**, we shall only be concerned with the absolute value of each control signal, and will ignore any positive-going excursions of the control signals.

With this definition, the curve labeled F represents the $V_{CF}$ control voltage signal; the curve labeled R represents the $V_{CR}$ control voltage signal; and the curve labeled B represents the $V_{CB}$ control voltage signal. These are on a polar plot with a linear voltage scale. It can easily be seen that for a signal at left, front, right, or back, one only of the control voltages is at maximum amplitude, while the remainder are all zero. But in the intermediate positions, the control voltages fall sharply from their maximum values, and just two are non-zero for any given direction of the sound source. It has been found that in conjunction with the VCA design discussed in co-pending application No. 07/533,091 this control voltage characteristic yields good separation and placement for such sound sources as phantoms between the nearest flanking loudspeakers provided in the sound system.

However, for purposes of dynamic control of the one-shot, the scheme previously used of comparing the difference signal to a threshold voltage to trigger the one-shot only works effectively when the voltages are changing from somewhere near their maximum values to zero or to values corresponding to signals in the opposite direction, or vice versa. Changes from, say, LF to RF, involve only a small change in the directional information signal $V_{LR}$ and therefore the one-shot 76 does not fire in these circumstances.

Because the control voltages vary in the manner shown, these curves also represent the maximum possible absolute difference signals that can occur when the circuit changes from an inactive no-signal state to a sudden loud sound from any encoded direction. The curves L and R represent the maximum possible values of the signal $V_{ABSLR}$, while the curves F and B represent the maximum possible values of the signal $V_{ABSFB}$. If the one-shot threshold voltage is set low enough to trigger on signals ±45° from any axis, this would be at about 700 mV, and the threshold is then far too sensitive with regard to signals close to the principal axes. On the other hand, if the threshold voltage is raised, the system does not respond well to signals from other than the principal directions.

A new approach to this problem was described with reference to FIGS. 6 and 7, namely, summing the absolute value signals and stretching the duration of any peaks to provide the PWM signal for modifying the variable time constants of the servologic circuit. In FIG. 8, the curve labeled S represents the maximum possible sum of the absolute values of the difference signals, and is derived by adding the intercepts of the two non-zero control voltages in each quadrant on the axes corresponding to the intermediate directions. It can be seen that this curve never falls below about 2.2V or some 37% of the maxima of 6V. It follows that, even for signals which originate in different intermediate directions such as LF and RF, the output of the duration stretching circuit will be no less than one third of the corresponding output for sudden changes in signals from the principal directions. This means that the time constants are reduced significantly for these intermediate directions as well as when the signal changes only occur between principal directions. The result is that the surround sound processor behaves more consistently with signals from intermediate directions than did previous designs without this feature.

Also, as the absolute difference signals are no longer compared With a threshold voltage, the directional performance is no longer concentrated in those regions where the one-shot is able to be fired, but is spread out more evenly around the sound stage. This yields a surround sound processor having improved apparent dynamic separation for all sound source directions, while retaining a greater degree of smoothness and freedom from unwanted artifacts than possible with the circuit of FIG. 3.

Figure 9A:
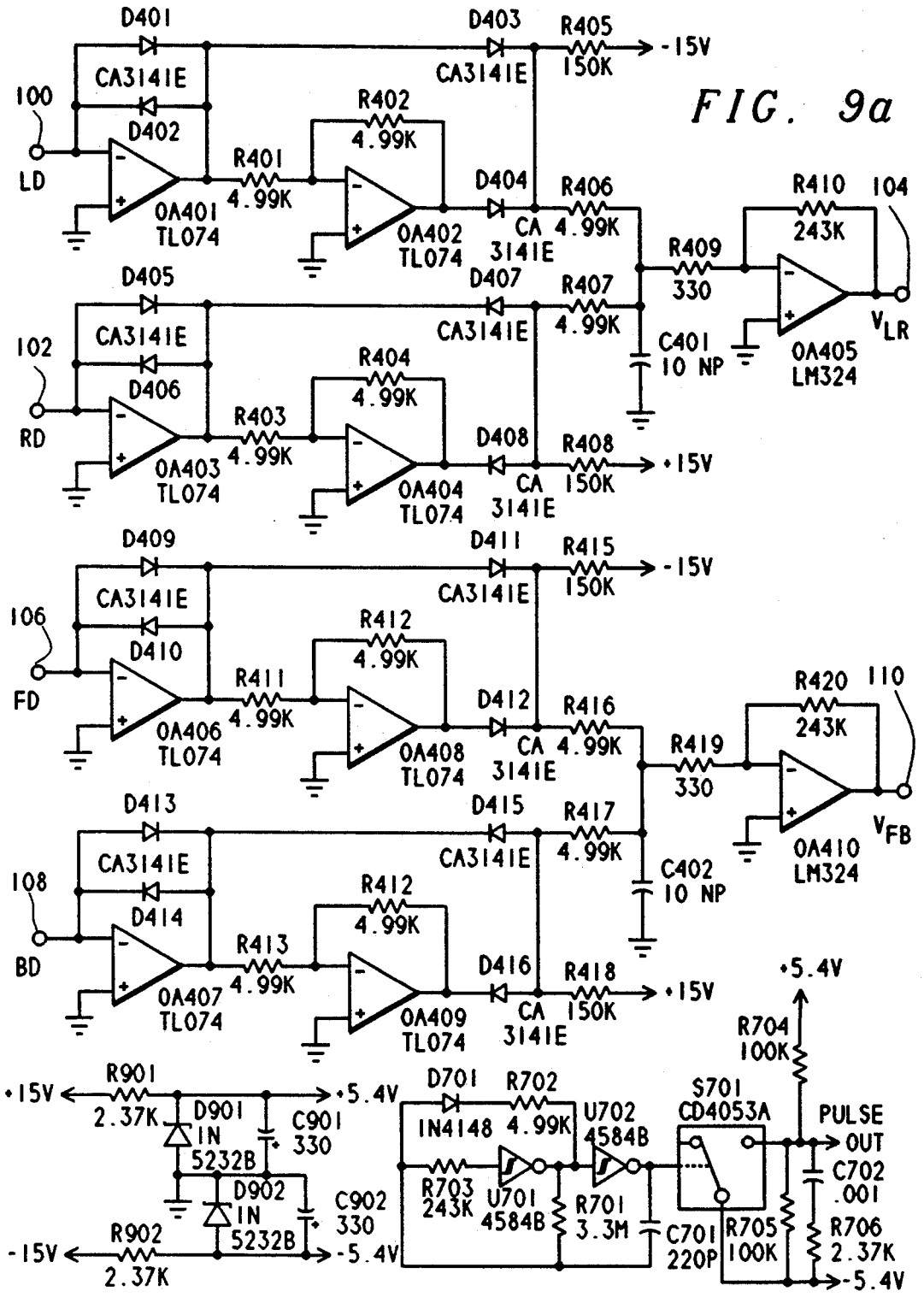
FIGS. 9*a* and 9*b* are a detailed schematic of a complete control voltage generator according to the present invention.
Figure 9B:
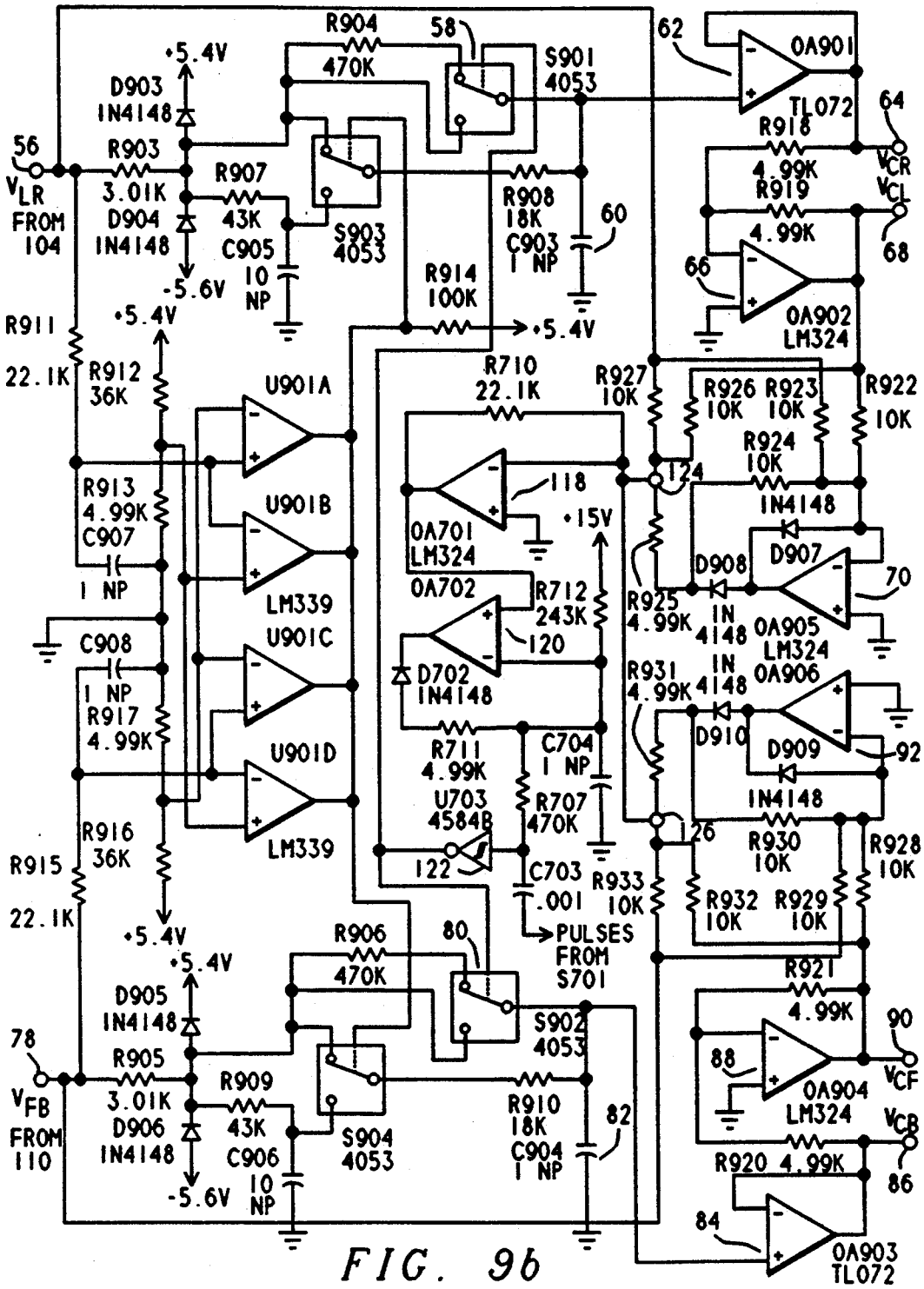

The complete schematic of a control voltage generator embodying the present invention (exclusive of the band-pass filter circuit) is shown in FIGS. 9*a* and 9*b*. This circuit performs both the servologic circuit function and the different time-constant processing associated with a Dolby Pro-Logic mode of operation, described by Mandell et. al in U.S. Pat. No. 5,046,098 and licensed by Dolby Laboratories Licensing Corporation. This function is shown here only for completeness and is not a necessary part of the present invention.

In FIG. 9*a* is shown the log ratio detectors 47 and 48 of FIG. 5, together with the ±5.4V power supplies derived on the card for the CMOS circuitry, and the pulse oscillator 128 and shaper 130 of FIG. 7. In FIG. 9*b*, the two servologic circuits 49 and 50 are shown, together with the servologic PWM circuit 132, summing amplifier 118 and duration stretching circuit 120, and the additional components required for the Dolby Pro-Logic operation mode.

With reference to FIG. 9*a*, the circuit of the log ratio detectors of FIG. 5 is reproduced, and will not be discussed in detail here. As in FIG. 5, the current signals LD, RD, FD, and BD are applied to the input terminals 100, 102, 106, and 108, respectively. The directional detector circuits are not shown with broken outlines here, to avoid cluttering the drawing. The directional information signals VLR and VFB appear at output terminals 104 and 110 respectively. Also not shown, but typically provided for each detector circuit, is a resistor of high value connected from the inverting input of operational amplifier OA405 to the wiper of a potentiometer connected between the positive and negative supply rails for precisely trimming the output $V_{LR}$ to zero when exactly equal signals are presented to terminals 100 and 102, nor an identical trimming circuit connected to the inverting input of operational amplifier OA410.

Below this circuitry at bottom left is a simple circuit for deriving the ±5.4V CMOS supply voltages from the regulated ±15 V supplies to the control voltage generator. Zener diodes D901 and D902 receive currents from resistors R901 and R902 respectively, generating these shunt-regulated voltages, which are further smoothed by capacitors C901 and C902.

Also at the bottom of FIG. 9*a* are the pulse oscillator 128 and pulse shaper 130 of FIG. 7, forming part of the improved pulse width modulation circuit 122. Again, broken outlines have been omitted here, as the circuit has been fully described with reference to FIG. 7.

In the circuit of FIG. 9*b*, there are the elements shown in FIG. 6, plus elements 118, 120 and 132 of FIG. 7, and in addition the elements for performing the alternative time constant processing according to the Dolby Pro-Logic requirements.

The directional information signal $V_{LR}$ from terminal 104 of FIG. 5 is applied to terminal 56, as in FIG. 6. The second directional information signal $V_{FB}$ from terminal 110 of FIG. 5 is applied to terminal 78.

The upper variable resistance element 58 comprises resistors R903, R904, diodes D903, D904, and CMOS switch element S901, in this case an industry type CD4053, although a CD4066 switch could be used instead. The advantage of the CD4053 is that it has separate digital supply and ground pins, allowing for easier interfacing. The resistor R903 and diodes D903 and D904, which are returned to ±5.4V supply voltages, perform the function of limiting the excursion of the voltage $V_{LR}$ prior to the time constant, as well as providing the shortest time constant, typically 3 ms. Resistor R904 adds in 470KΩ whenever switch S901 is off, lengthening the time constant with the capacitor C903 to as much as 470 ms when the PWM duty cycle is zero. Similar considerations apply to the lower variable resistance element 80, which comprises resistors R905, R906, diodes D905, D906, and switch S902, and to capacitor C904.

An alternative time constant processing method as described by Mandell et. al in the cited reference is provided by the CMOS switch elements S903 and S904, with resistors R907–R910 and capacitors C905 and C906. It should be noted that CMOS switches S901–S904 also have an enable control pin, not shown, which enables or disables the switch completely. In the servologic mode, switches S903–S904 are disabled, and switches S901–S902 are enabled. In the alternative mode, switches S901–S902 are disabled and switches S903–S904 are enabled. This switching of the enable pins is not shown here, but is controlled by the voltage applied to MODE terminal 51 in FIG. 2, directly or through a CMOS inverter stage.

In the upper circuit, resistor R907 and capacitor C905 provide a slow time constant of about 430 ms from the limited output signal $V_{LR}$ of the directional detector. Switch S903 selects between the voltage on capacitor C905 and $V_{LR}$, and connects through resistor R908 to capacitor C903. When switch S903 is on, a fast time constant of 18 ms results from the combination of resistor R908 with capacitor C903. When switch S903 is off, the 430 ms time constant is added in.

Similarly, in the lower circuit, resistor R909 and capacitor C906 provide the slow 430 ms time constant, and resistor R910 with capacitor C904 provides the fast time constant, switch S904 serving to connect either the slow or fast time constant in circuit.

Both switches S903 and S904 receive their control signal from the same circuit, shown at the left in the center of FIG. 9*b*. This circuit comprises a quad comparator, typically industry type LM339, whose sections are labeled U901A D. The directional information signal $V_{LR}$ is applied through resistor R911 to a capacitor C907, providing a time constant of 22 ms. The signal on this capacitor C907 is compared in comparator sections U901A and U901B with a negative and a positive threshold voltage. Resistors R912 and R91 provide this positive threshold voltage of about 660 mV by voltage division from the +5.4V supply rail. When the voltage on capacitor C907 exceeds this threshold voltage, comparator section U901B changes state to an "on" condition, causing its open-collector output transistor to pull down the voltage on the line controlling switches S905 and S906. This voltage is held at +5.4V by resistor R914, unless one or more of the four comparators U901A-D is turned on, thereby selecting the slow time constant. The switches S903 and S904 are therefore switched to select the long time constant until one or more of the comparators U901A-D is on.

Resistor R915, with capacitor C908, receives the $V_{FB}$ signal from terminal 78, applies a 22 ms time constant to it, and the resulting signal is applied to comparator sections U901C-D.

Resistors R916 and R917 provide a negative threshold voltage of −660mV by dividing the −5.4V supply rail voltage. When the voltage on capacitor C907 goes more negative than this threshold, comparator section U901A turns on, selecting the fast time constant.

Similarly, the voltage on capacitor C908 is applied to comparator sections U901C-D and compared to the same threshold voltages, so that if the voltage on capacitor C908 exceeds the positive threshold, comparator section U901D is turned on, while if it goes more negative than the negative threshold voltage, comparator section U901C is turned on.

When any of the comparators U901A-D are turned on, switches S903 and S904 are changed over to the short time constant (as shown), bypassing the long time constants provided by resistors R907 and R909 with capacitors C905 and C906 respectively.

The capacitors C903 and C904 are also identified as elements 60 and 82 respectively of FIG. 6. Operational amplifier OA901, connected as a source follower, is the buffer 62 of FIG. 6, and its output is connected to terminal 64 to provide the control voltage signal $V_{CR}$ to the variable matrix circuit 8 of FIG. 1. Operational amplifier OA902, with equal input and feedback resistors R918 and R919, provides the function of inverter 66 of FIG. 6. The output voltage is connected to terminal 68 to provide the control voltage signal $V_{CL}$ to the variable matrix 8.

Operational amplifier OA903, in source follower connection, provides the buffer 84 and its output at terminal 86 is the control voltage signal $V_{CF}$. Resistors R920 and R921, with operational amplifier OA904, provide the inverter 88, whose output is connected to terminal 90 to provide the control voltage signal $V_{CB}$. Amplifiers OA901 and OA903 are typically a BiFET type such as industry type TL072, while op-amps OA902 and OA904 may be sections of an inexpensive type such as industry type LM324.

At the center right of FIG. 9*b*, two summing full-wave rectifier circuits similar to that of FIG. 4 are provided. Resistors R922 and R923 connect the $V_{CL}$ and $V_{LR}$ signals from terminals 68 and 56 respectively into the inverting input of op-amp OA905. This has the diode D907 in its feedback circuit plus the diode D908 and resistor R924 providing rectification. Resistor R925 provides a current to terminal 124, corresponding with the like-numbered terminal in FIG. 7. This point is typically connected to the virtual ground inverting input of an op-amp, as can be seen in block 70 of FIG. 4. Thus amplifier OA905 is identified with the label 70, although the summing full-wave rectifier is understood to include the surrounding components also. To avoid cluttering the drawing, block outlines for the separate sections are omitted, as in FIG. 9*a*.

Resistors R926 and R927 provide balancing currents to terminal 124, so that a net current proportional to the magnitude of the difference signal is provided to the terminal 124.

Similarly, in the lower half of FIG. 9*b*, op-amp OA906 forms summing full-wave rectifier 92, with its surrounding components. Resistors R928 and R929 provide the input currents from terminal 90 and 78; resistor R930, with diodes D909 and D910, provides rectification, and resistor R931 provides the rectified current to terminal 126. Resistors R932 and R933 provide the balancing current to this terminal.

As shown in FIG. 7, terminals 124 and 126 are connected in common to a single inverting amplifier 118, provided by op-amp OA701 with feedback resistor R710. The resistors R708 and R709 shown in FIG. 7 are connected between the inverting input of this amplifier 118 and the +5.4V supply voltage, although not shown in FIG. 9*b*. The duration stretching circuit 120 comprises amplifier OA702, with resistors R711, R712 and capacitor C704. The pulse width modulator 132 comprises Schmitt trigger inverter U703, resistor R707 and capacitor C703. These circuits have been described above with reference to FIG. 7, and no further detail is given here. The modulator receives its input from the pulse generator on FIG. 9*a*, and its output is applied to both switches S901 and S902. Thus the circuitry has been considerably simplified relative to that of FIG. 4, most of which is duplicated.

The components illustrated in FIGS. 4, 5, 7, 9*a* and 9*b* are commercially available types from various manufacturers and are meant to provide useful suggestions as to the design of a circuit appropriate for performing the functions desired according to this invention. The resistor values and component types used may be modified without necessarily deleterious effects on the system performance, although the values preferred are shown.

In particular, varying the value of the resistor R710 will affect the gain of the servologic circuit and may make the time constant variations more or less aggressively, depending upon this gain. And varying resistors R410 and R420 of FIG. 5 or FIG. 9*a* will change the shapes of the curves of directional detector performance shown in FIG. 8. Since these determine the dynamics of the processor performance with sound sources from intermediate directions, variation of these resistors will alter how the detector responds to such signals according to the preference of the circuit designer.

These and many other modifications will become apparent to those experienced in the art, without departing from the spirit of the present invention.

What is claimed is:

1. A surround sound processor for reproduction of a stereophonic audio signal on a plurality of loudspeakers surrounding a listening area, said processor including at least an input conditioning and matrix circuit, a directional detector circuit, a servologic circuit and a variable matrixing circuit, the said servologic circuit comprising:

means for receiving at least one directional information signal derived from said directional detector circuit;

means for smoothing said at least one directional information signal with a variable time constant to produce at least one corresponding smoothed directional information signal;

means for buffering each of said at least one smoothed directional information signals to provide at least one control voltage signal;

means for inverting each said at least one control voltage signal to provide a second control voltage signal corresponding thereto but of opposite polarity;

means for combining each said at least one directional information signal with an equal proportion of said at least one second control voltage signal and full-wave rectifying the combination thereof to produce at least one absolute value signal;

means for summing each of said at least one absolute value signals to produce a summed absolute value signal;

means for extending the duration of peak values of said summed absolute value signal to provide a resistance control signal; and means for varying the variable time constant of said smoothing means in response to the value of said resistance control signal, such that the variable time constant is reduced whenever said resistance control signal increases in magnitude, and vice versa.

2. The apparatus of claim 1 wherein said means for varying the variable time constant of said smoothing means is a means for providing a train of width-modulated pulses whose duty ratio increases as the value of said resistance control signal increases, and wherein said variable time constant smoothing means comprises a switch responsive to said train of width-modulated pulses for selecting either a long or a short time constant, thereby providing an average time constant which varies inversely with the value of said resistance control signal.

3. A surround sound processor for reproduction of a sterephonic audio signal on a plurality of loudspeakers surrounding a listening area, said processor comprising at least an input conditioning and matrixing circuit, a directional detector circuit, a servologic circuit and a variable matrixing circuit, said servologic circuit being for imposing variable time constant smoothing on first and second directional information signals derived from said directional detector circuit to obtain first, second, third and fourth control voltage signals for controlling said variable matrixing circuit, said servologic circuit comprising:

first and second terminals for receiving said first and second directional information signals;

first and second identical variable resistance elements having a resistance controlled by a modulated pulse train signal applied to a control terminal thereof;

first and second capacitors for smoothing said first and second directional information signals, respectively, said first and second variable resistance elements being connected between said first and second terminals and one terminal of each of said first and second capacitors respectively, and the other terminal of each of said first and second capacitors being grounded;

first and second buffer amplifiers for buffering said smoothed first and second directional information signals appearing on said first and second capacitors respectively, and providing at their outputs said first and second control voltage signals respectively;

first and second inverter amplifiers for inverting said first and second control voltage signals to provide said third and fourth control voltage signals respectively at their outputs;

first summing full-wave rectifier circuit, connected to said first terminal and the output of said first inverter amplifier and operative to produce at its output a first absolute value signal proportional to the absolute value of the sum of said first directional information signal and said third control voltage signal;

second summing full-wave rectifier circuit, connected to said second terminal and the output of said second inverter amplifier and operative to produce at its output a second absolute value signal proportional to the absolute value of the sum of said second directional information signal and said fourth control voltage signal;

a summing amplifier connected to sum said first and second absolute value signals at the outputs of said first and second summing full-wave rectifier circuits;

a duration stretching circuit for imposing a slow decay time constant on the output of said summing amplifier to produce a resistance control signal; and a pulse width modulation circuit responsive to said resistance control signal from said duration stretching circuit, for producing a modulated pulse train signal, which is applied to said control terminals of both said first and second variable resistance elements for reducing their resistances in tandem as the magnitude of said resistance control signal increases;

thereby decreasing said smoothing time constants applied to said first and second directional information signals in response to rapid changes of one or both said directional information signals and increasing said smoothing time constants when said first and second directional information signals are both varying relatively slowly.

4. The apparatus of claim 3 wherein said pulse width modulation circuit comprises:

a pulse oscillator circuit providing repetitive rectangular pulses of short duration at an ultrasonic frequency;

a pulse shaping circuit for shaping said rectangular pulses and providing an exponential decay thereon;

a modulator circuit for combining said shaped pulses from said pulse shaping circuit and the output signal from said duration stretching circuit and providing at its output a train of width-modulated pulses whose duty ratio increases with the output signal from said duration stretching circuit.

5. The apparatus of claim 4 wherein said pulse oscillator circuit comprises:

a first resistor and first and second Schmitt trigger inverter elements in series;

a capacitor in parallel therewith;

a diode and a second resistor in series, and a third resistor in parallel therewith, connected from the junction of said first resistor and said capacitor to the output of said first Schmitt trigger inverter element; thereby producing short pulses at a high frequency, and wherein said pulse shaper circuit comprises:

first and second equal resistors connected between equal positive and negative supply voltages;

a capacitor and a third resistor in series therewith, connected in parallel with said second resistor; and a voltage-controlled switch operated by the pulses from said pulse oscillator circuit to short-circuit said second resistor momentarily during the short pulses, discharging said capacitor through said third resistor, and to permit said capacitor to recharge during the remainder of the pulse oscillator period approximately in an exponential manner, and wherein said modulator circuit comprises:

a Schmitt trigger inverter element;

a capacitor coupling the output of said pulse shaper circuit to the input of said Schmitt trigger inverter element; and a resistor coupling the output of said duration stretching circuit to the input of said Schmitt trigger element;

thereby producing at the output of said Schmitt trigger element a train of pulses whose duty ratio depends upon the output voltage of said duration stretching circuit.

6. The apparatus of claim 3 wherein said first and second variable resistance elements each comprise a voltage-controlled switch in combination with two resistors, such that when said voltage controlled switch is in a first condition the resistance of said variable resistance element is greater than when said voltage-controlled switch is in a second condition;

said voltage-controlled switch being rapidly alternated between said first and second conditions by means of a modulated pulse train signal comprising a train of width-modulated pulses applied to its control terminal;

and thereby providing an average resistance value dependent upon the duty ratio of said width-modulated pulses forming said modulated pulse train signal.

7. The apparatus of claim 3 wherein each of said first and second directional information signals passing through said first and second variable resistance elements is also symmetrically limited by first and second limiting means respectively contained therein to an appropriate maximum amplitude.

8. The apparatus of claim 7 wherein said first and second limiting means contained in said first and second variable resistance elements each comprise a first resistor, first and second diodes, said first resistor being connected from said first or second terminal respectively to the anode of said first diode and the cathode of said second diode, the cathode of said first diode and the anode of said second diode being returned to suitable equal positive and negative supply voltages respectively;

and wherein each of said first and second variable resistance elements further comprises a second resistor and a voltage-controlled switch, operative to connect its output terminal through said second resistor to the junction of said first resistor and said first and second diodes when said voltage-controlled switch is in said first condition, and to connect its output terminal directly to the junction of said first resistor and said first and second diodes when said voltage-controlled switch is in said second condition;

thereby to provide an effective resistance between its terminals equal to the sum of said first and second resistors when said voltage-controlled switch is in said first condition and an effective resistance equal to that of said first resistor alone when said voltage-controlled switch is in said second condition, and to limit the maximum voltage excursions at the output of said voltage-controlled switch symmetrically to voltages defined by the forward voltages of said first and second diodes and said equal positive and negative supply voltages.

9. The apparatus of claim 3 wherein said duration stretching circuit comprises:

an operational amplifier circuit, whose non-inverting input is the input of the duration stretching circuit;

a diode in series with a first resistor, connected from the output of said operational amplifier to the input thereof;

a capacitor connected to ground from the inverting output of said operational amplifier; and a second resistor connected from the inverting input of said operational amplifier to a suitable supply voltage for forward-biasing said diode and for providing a long time constant with said capacitor;

said circuit operating such that the output voltage follows the input voltage while the said diode conducts, in the direction of increasing output voltage from the said summing amplifier, and decays towards ground at a slow rate when the said diode ceases to conduct, as the output voltage from said summing amplifier decreases, thereby stretching the duration of peak outputs of said summing amplifier.

10. A surround sound processor for reproduction of a stereophonic audio signal on a plurality of loudspeakers surrounding a listening area, said processor comprising at least an input conditioning and matrixing circuit, a directional detector circuit, a servologic circuit and a variable matrixing circuit, said directional detector circuit being for producing for audio input signal currents a first and second directional information signal, and comprising two identical circuits, each such identical circuit comprising:

first and second input terminals for receiving first and second audio signal currents;

a first operational amplifier whose non-inverting input is grounded, with a first pair of matched diodes connected in antiparallel between its output an its inverting input, its inverting input being connected to said first input terminal;

a second operational amplifier whose non-inverting input is grounded, with a second pair of matched diodes connected in antiparallel between its output and its inverting input, its inverting input being connected to said second input terminal;

a third operational amplifier whose non-inverting input is grounded, with a first resistor connected between its output and its inverting input, its inverting input being connected through a second resistor of equal value to said first resistor to the output of said first operational amplifier;

a fourth operational amplifier whose non-inverting input is grounded, with a third resistor of equal value to said first resistor connected between its output and its inverting input, its inverting input being connected through a fourth resistor of equal value to said third resistor to the output of said second operational amplifier;

a third pair of matched diodes whose anodes are connected to the outputs of said first and third operational amplifiers respectively and whose cathodes are connected in common to a fifth resistor;

a fourth pair of matched diodes whose cathodes are connected to the outputs of said second and fourth operational amplifiers respectively and whose cathodes are connected in common to a sixth resistor of equal value to said fifth resistor;

said fifth and sixth resistors also being connected to a capacitor whose other terminal is grounded, and to a seventh resistor;

a fifth operational amplifier whose non-inverting input is grounded, having an eighth resistor connected between its output and its inverting input, said seventh resistor also being connected to its inverting input, and its output being connected to an output terminal;

a first biasing resistor connected from the cathodes of said third pair of matched diodes to a suitable negative supply voltage, for biasing said third matched pair of diodes; and a second biasing resistor equal to said first biasing resistor, connected from the anodes of said fourth pair of matched diodes to a positive supply voltage of equal magnitude to said negative supply voltage for biasing said fourth pair of matched diodes with an equal current to that provided by said first biasing resistor for biasing said third pair of matched diodes;

wherein said seventh resistor is of much lower value than said fifth and sixth resistors, so as to prevent significant interaction between the outputs of said second and fourth operational amplifiers, and said capacitor provides with said seventh resistor in parallel with said fifth and sixth resistors a suitable time constant for smoothing the net current received through said fifth and sixth resistors, said circuit being operative to provide at its output terminal a voltage proportional to the logarithm of the ratio of the amplitudes of the audio signal currents applied to its first and second input terminals.

* * * * *

UNITED STATES PATENT AND TRADEMARK OFFICE

CERTIFICATE OF CORRECTION

PATENT NO. : 5,295,189

DATED : March 15, 1994

INVENTOR(S) : James W. Fosgate

It is certified that error appears in the above-identified patent and that said Letters Patent is hereby corrected as shown below:

Col. 1, line 40, "noticeable" should be --noticeably--.
Col. 6, line 2, "-B-" should be -- -B' --.
Col. 7, line 21, "circuit 5" should be --circuit 54--.
Col. 7, line 25, "making u" should be --making up--.
Col. 7, line 26, "circuit 5" should be --circuit 54--.
Col. 9, line 49, "circuit are" should be --circuit 49 are--.
Col. 9, line 55, "ma be" should be --may be --.
Col. 10, line 35, "sam one-shot" should be --same one-shot--.
Col. 11, line 8, "may b=" should be --may be--.
Col. 13, line 26, "output o inverter" should be --output of inverter--.
Col. 13, line 53, "direction 8" should be --direction 0--.
Col. 15, line 46, "VLR and VFB" should be --$V_{LR}$ and $V_{FB}$--.
Col. 16, line 65, "R912 and R91" should be --R912 and R913--.

Signed and Sealed this

Fifth Day of July, 1994

*Attest:*

*Attesting Officer*

BRUCE LEHMAN

*Commissioner of Patents and Trademarks*